US005107734A

United States Patent [19]

Armbruster

[11] Patent Number: 5,107,734

[45] Date of Patent: Apr. 28, 1992

[54] ELECTRICALLY POWERED DISPENSER FOR ROLLED SHEET MATERIAL

[76] Inventor: Joseph M. Armbruster, 2700 NE. 47th St., Lighthouse Point, Fla. 33064

[21] Appl. No.: 76,402

[22] Filed: Jul. 22, 1987

[51] Int. Cl.[5] ..... B26D 5/20

[52] U.S. Cl. ..... 83/205; 83/614; 83/649

[58] Field of Search ..... 83/487, 488, 205, 455, 83/456, 649, 650, 614

[56] References Cited

U.S. PATENT DOCUMENTS

| | | | |
|---|---|---|---|
| 1,543,183 | 6/1925 | Mortimer | 83/649 X |
| 3,436,997 | 4/1969 | Abraham et al. | 83/205 |
| 3,748,939 | 7/1973 | Feinstein et al. | 83/370 |
| 3,919,905 | 11/1975 | Hoffman | 83/205 |
| 3,998,120 | 12/1976 | Granger et al. | 83/335 |

*Primary Examiner*—Frank T. Yost
*Assistant Examiner*—Eugenia A. Jones
*Attorney, Agent, or Firm*—Fleit, Jacobson, Cohn, Price, Holman & Stern

[57] ABSTRACT

An electrically operated dispenser for sheet material normally supplied in a spirally wound roll such as paper towels, toilet tissue, aluminum foil, plastic wrap and the like and more specifically a dispenser which is electrically powered to move the web of sheet material through a discharge slot until a desired length of material has been dispensed with the dispenser then automatically cutting the web so that the cut-off length of sheet material can be utilized with the cut-off edge connected with the supply roll of sheet material being disposed inwardly of the discharge slot for concealing the end edge of the supply roll of web material.

1 Claim, 2 Drawing Sheets

ELECTRICALLY POWERED DISPENSER FOR ROLLED SHEET MATERIAL

BACKGROUND OF THE INVENTION

1. Field of the Invention

The present invention generally relates to a dispenser for sheet material normally supplied in a spirally wound roll such as paper towels, toilet tissue, aluminum foil, plastic wrap and the like and more specifically to such a dispenser which is electrically powered to move the web of sheet material through a discharge slot until a desired length of material has been dispensed with the dispenser then automatically cutting the web so that the cut-off length of sheet material can be utilized with the cut-off edge connected with the supply roll of sheet material being disposed inwardly of the discharge slot for concealing the end edge of the supply roll of web material.

2. Information Disclosure Statement

Various structures have been provided for supporting rolls of sheet material in accessible position so that the sheet material may be unwound from the roll and severed therefrom for use. Rolls of sheet material frequently are provided with tear-off lines at regular intervals to facilitate removal of a desired quantity of sheet material for use. Other dispensers are provided with devices which facilitate cutting of the web of sheet material. For example, paper toweling is supplied in rolls and frequently is supported in a convenient position in the kitchen for various uses. Also, aluminum foil, plastic wrap, toilet tissue and the like are also provided in rolls and various arrangements have been provided to facilitate the dispensing of such materials. Powered devices to dispense web material are known and various types of manually manipulated cut-off devices are known and power operated devices are also known for cutting a web of sheet material at a desired length. However, the prior art does not utilize a structural arrangement capable of functioning in the manner of the present invention.

SUMMARY OF THE INVENTION

An object of the present invention is to provide an electrically operated dispenser for sheet material provided in a spirally wound roll in which the web of sheet material is discharged through a discharge slot in a housing receiving the roll of material with the sheet material being automatically cut when a desired length of sheet material has been dispensed through the slot with the housing, cutter and discharge slot being arranged so that the cut-off end of the web of sheet material is disposed just inwardly of the discharge slot so that it cannot be observed.

Another object of the invention is to provide a dispenser for a rolled web of sheet material in accordance with the preceding object in which the web of sheet material is moved through the discharge slot by two pairs of electrically driven, geared feed rollers which engage the top and bottom surfaces of the web of material adjacent the discharge slot to maintain the web of material under tension and for moving the free end of the web material through the discharge slot with a manually operated switch being provided to control operation of the motor driven rollers with the rollers being driven as long as the manual switch is depressed with the release of the manual switch stopping discharge of the web of sheet material and automatically actuating a cutting mechanism to cut the web of material so that the dispensed length thereof may be utilized.

A further object of the invention is to provide a dispenser in accordance with the preceding objects in which the cutter mechanism includes a cutter blade which is vertically oriented and guided for reciprocatory movement between the pairs of dispenser rollers with a guide bar being provided above the rollers for this purpose and a solenoid arrangement being provided to move the cutter blade in one longitudinal direction and return spring returning the cutter blade to its original position for a subsequent cutting operation.

Still another object of the invention is to provide a dispenser in accordance with the preceding objects in which the roll of web material is received within a hollow housing having one end which is pivotal to enable the roll of material to be placed on spring loaded idler cones with the housing and related structure being duplicative to enable a multiple tiered arrangement for independently dispensing and cutting web material such as paper toweling, aluminum foil, plastic wrap or the like which enables such materials to be stored in an attractive housing without any loose ends projecting from the housing and enabling quick and efficient dispensing and cutting of a desired length of the web material or materials.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
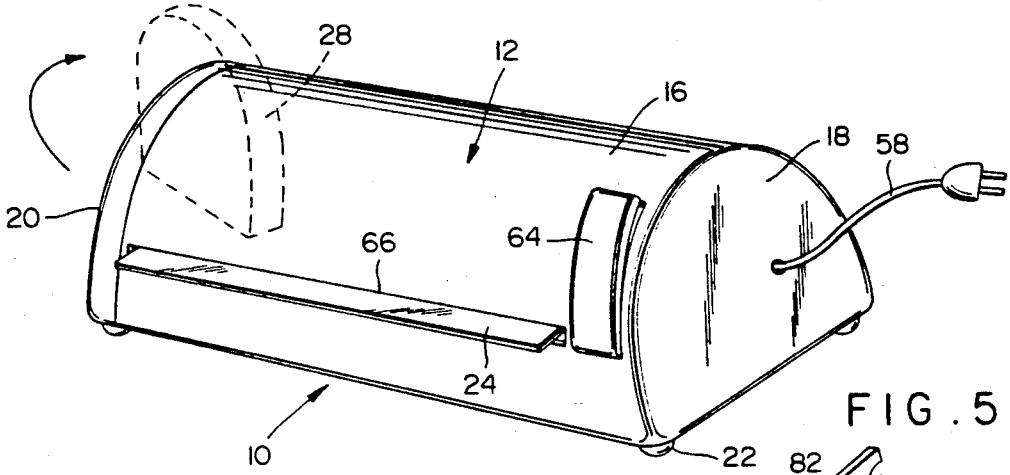
FIG. 1 is a perspective view of the dispenser of the present invention.
Figure 5:
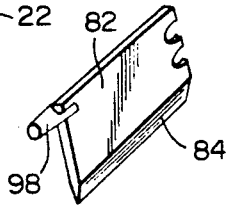
FIG. 5 is a fragmental perspective view illustrating the cutter blade.
Figure 2:
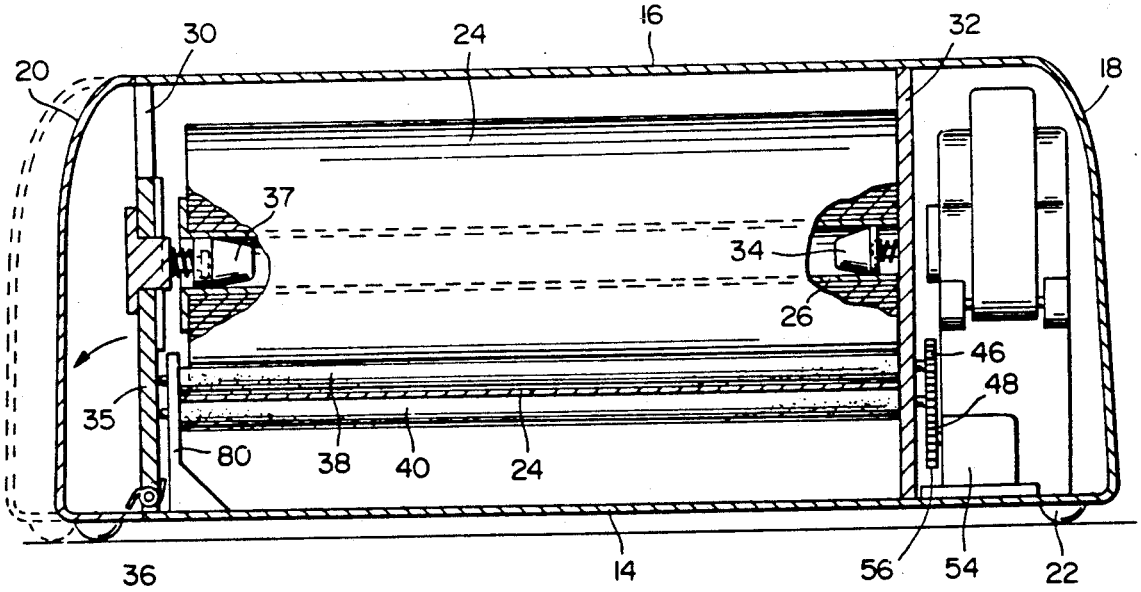
FIG. 2 is a longitudinal, sectional view of the dispenser.
Figure 3:
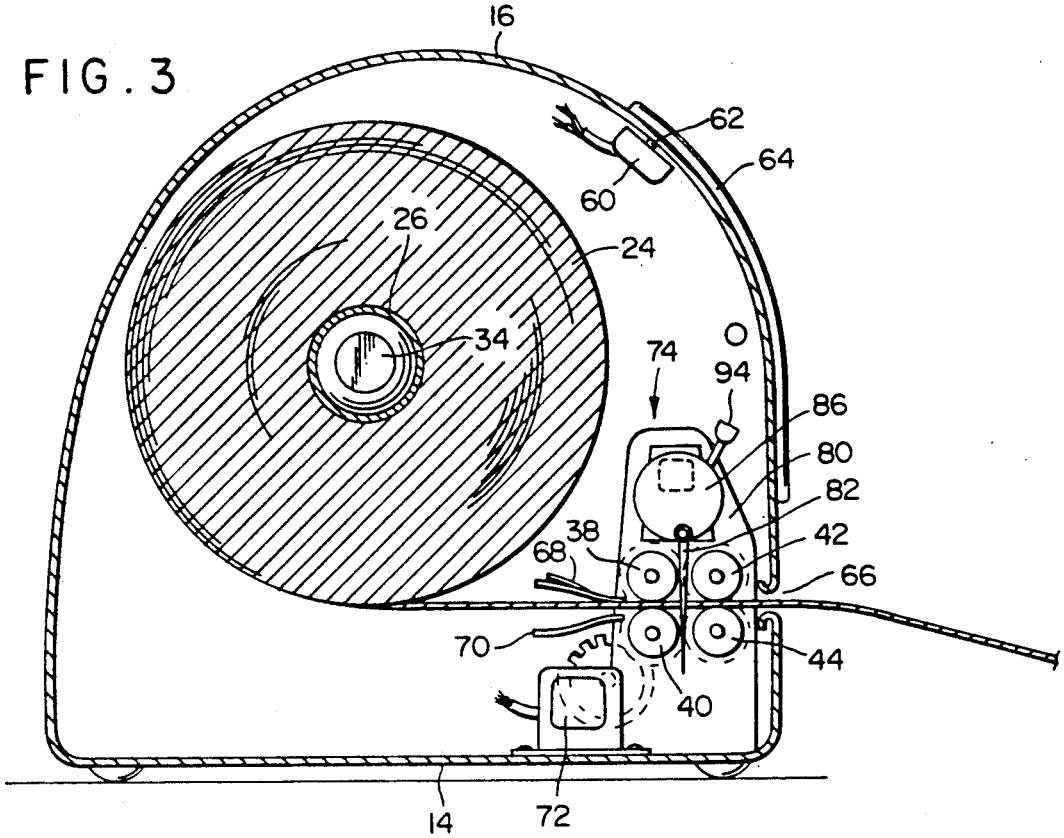
FIG. 3 is a transverse, sectional view of the dispenser illustrating the association of the components of the device.
Figure 4:
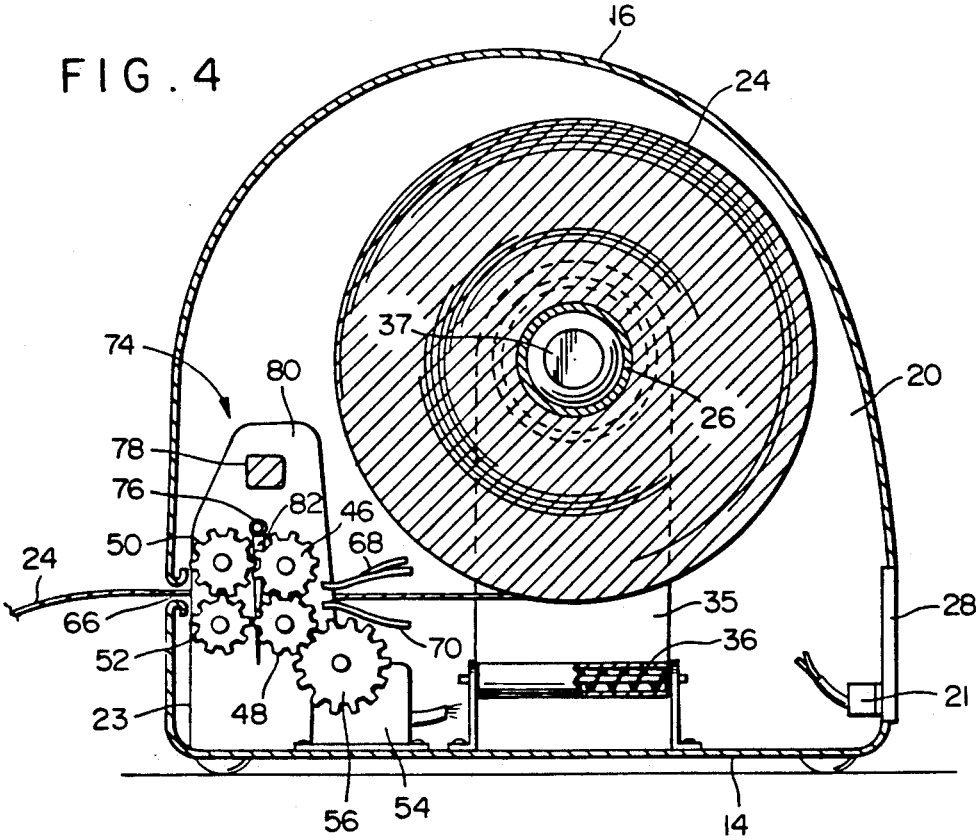
FIG. 4 is a transverse, sectional view of the dispenser opposite to FIG. 3.

The dispenser of the present invention is generally designated by reference numeral 10 and includes a housing 12 having a generally flat, horizontal bottom wall 14 and a hollow upper wall 16 that includes a curved upper portion which may be oval-shaped in configuration, symmetrical or any desired shape with the housing including end walls 18 and 20. The bottom wall 14 is provided with supporting pads or feet 22 adjacent the corners thereof by which the dispenser may be supported on a supporting surface such as a countertop in the kitchen or the like. The dispenser also may be constructed so that it can be supported in suspended relation by brackets under a kitchen cabinet or other supporting structures. The hollow interior of the housing 16 receives a roll of spirally wound sheet material 24 such as paper toweling, aluminum foil, plastic wrap, toilet tissue or other similar material which is provided with a tubular central core 26 of cardboard or similar material. The web of sheet material 24 may or may not be provided with tear-off lines with the size and configuration of the housing 12 being sufficient to enable a full roll of sheet material 24 to be positioned therein through an open end of the hosing formed by the end wall 20 being pivotally connected to the end edge of the bottom wall 14 by a hinge structure 28 with the peripheral edge 30 of the end wall 20 telescoping into the interior of the housing 16 as illustrated in FIG. 4. The specific construction of the hinge 28 and latch structure to secure the end wall 20 in closed position enables the roll of sheet material to be easily inserted and replaced when desired. The interior of the housing 12 includes a support which may be a partial wall 32 having a centrally disposed projecting freely rotatable cone 34 which partially telescopes into the hollow core 26 of the roll of sheet material 24. Also, the pivotal end wall 20 covers a support member 35 that is hingedly connected to the bottom wall 14 by a spring hinge 36 and provided with a freely rotatable spring loaded cone 37 in engagement with the opposite end of the cone 26 of the roll of web material 24 so that the roll of web material will have a degree of frictional resistance to free rotational movement.

The sheet material 24 is removed from its roll along the bottom thereof and extends between two pairs of horizontally disposed dispensing rollers 38, 40, 42 and 44 which pinch the web of sheet material 24 there between. The rollers 38 and 40 are disposed in vertical alignment and are horizontally spaced from and aligned with rollers 42 and 44. The periphery of the rollers are provided with a resilient coating such as rubber, plastic or the like to frictionally grip the opposed top and bottom surfaces of the web of sheet material 24. The rollers are geared together by end gears 46, 48, 50 and 52 with gear 48 being driven by a geared electric motor 54 disposed in housing 12 between the partition wall 32 and the end wall 18 with the motor being provided with an output gear 56 and supplied with electrical energy from a cord and plug 58 is a well known manner. A switch 60 is provided for controlling operation of the motor 54. The switch 60 is oriented against the inner surface of the top portion of the top wall 16 of the housing 12 and is provided with a plunger 62 engaged by an accurate actuator plate 64 mounted on the exterior of the housing 12 with a pivot pin supporting the lower end of the actuator plate 64 from the housing 12 so that when the plate 64 is depressed, the switch 60 will be closed thus energizing the motor 54 for rotating the bottom rollers 40 and 44 in opposite directions to the top rollers 38 and 42 to move the web of sheet material 24 through a discharge slot 66 in horizontal alignment with the contacting portions of the rollers. A pair of inwardly diverging paper guide plates 68 and 70 extend from the nip of rollers 38 and 40 toward the lower edge of the roll 24. When the roll 24 of sheet material is placed in the housing, the end edge of the web of sheet material is inserted between the guide plates 68 and 70 and into the nip of rollers 38 and 40 sufficiently to enable the rollers 38 and 40 to grip the web of sheet material and extend it into the nip of rollers 42 and 44 and through discharge slot 66 when the motor 54 is actuated by depressing a start/feed switch 72 that is accessible when end wall 20 is open.

In order to cut the web of sheet material after a desired length has been dispensed, a cutter assembly generally designated by numeral 74 is provided and includes a carriage 76 in the form of a body or block slidably mounted on a cutter guide bar 78 of square or other polygoval configuration. The bar 78 and rollers are supported by end members 80 projecting upwardly from the bottom wall 14 with the bar disposed above the rollers 38 and 42 so that a cutter blade 82 supported from carriage 76 has its sharp lower edge 84 extending downwardly between rollers 38 and 42 and 40 and 44.

To move the carriage 76 longitudinally from end to end of the guide bar 78, a solenoid 86 is provided and includes a core or plunger that will engage the carriage 76 and project it longitudinally from one end of the guide bar 78 to the other. A return coil tension spring is connected to the carriage 76 and the support members 80 so that the spring will be tensioned when the carriage 76 is projected toward the opposite end of the housing in order to return the carriage 76 to its initial position. The other end of the guide bar is provided with a coil dampening spring or rubber snubber which will engage and cushion the carriage 76 as it approaches the opposite end of the guide bar 78. The movement of the carriage and cutter thereon is such that it will move from a position closely adjacent one side edge of the web of sheet material 24 to a position beyond the opposite edge thereof so that the web of sheet material will be cut. The solenoid and plunger or core are constructed so that the carriage 76 will be projected with sufficient velocity, that it will move at a high rate of speed throughout the length of the guide bar and be cushioned at the opposite end by the dampening spring or other suitable dampening structure such as a resilient member of the like and the carriage then will be returned to its initial position by the spring. The solenoid 86 will be automatically energized when the switch plate 64 is released which stops the motor 54. Thus, any time the push plate 64 is depressed, the motor 54 will be actuated to discharge the web of sheet material which will continue to discharge as long as the push plate 64 is depressed. Immediately when the push plate 64 is released, the motor will stop thus stopping discharge of the web of sheet material and the solenoid 86 will be automatically energized thus automatically cutting the web of sheet material so that it can be used without the person using the device being required to manipulate the sheet of material against a cutting member. The end edge of the web of sheet material will be oriented inwardly of the discharge slot 66 so that it cannot be observed thereby providing a neat and attractive dispenser for sheet material.

When the actuator 64 is depressed, the gear motor is actuated to drive the four rubber coated pinch rollers 38, 40, 42 and 44, at a speed to move the web or paper towel at about 7 inches per second. The web will be discharged through slot 66 until actuator 64 is released at which time the motor stops and the solenoid 86 is energized to propel the carriage 76 and cutter blade 82 between the two sets of rollers and completely across the width of the web thereby completely severing the web. After the cutting operation is completed, the spring 90 returns the carriage to its starting point. At this time, the end edge of the web extending from the supply roll is still gripped between the first set of rollers 38 and 40.

When carriage 76 is returned, the gear motor 54 is momentarily actuated for advancing the end edge of the web through the second set of rollers 42 and 44 and stopping just prior to the end edge of the web going through discharge slot 66. This position is maintained with the web held taut between the two sets of rollers thereby eliminating the probability of the web falling down between the sets of rollers. This also will discharge the trailing end of the severed length of web from rollers 42 and 44 unless it was pulled outwardly by the person using the device. This momentary actuation of motor 54 is obtained by the use of standard electronic controls.

In loading a new roll of material, the fingers of a person cannot enter the area between the sets of rollers where the cutter blade is located and a disabling interlock switch 21 actuated when end wall 20, which forms a door, is released by latch 23 and moved to open position prevents operation of cutter assembly 64 until end wall 20 is moved to closed position. The support member 35 is pivoted outwardly and downwardly to enable empty core 26 to be removed and a new roll positioned between the spring loaded cones 34 and 37. The end edge of the web is then fed between guide plates 68 and 70 into the nip between rollers 38 and 40. The start feed switch 72 is then actuated while the end of the web is fed inwardly between the rollers so that it is captured by the first set of rollers and passed through the second set and through the discharge slot. After closing the end wall 20, depressing the actuator 64 momentarily will actuate the cutter assembly and will remove the uneven tag end of the web of material so that no web material extends through the slot.

In order to change the blade 82, the left end wall 20 is opened and provides access to a slot in the support member 80 adjacent thereto. The support member 80 supports the rollers 38, 40, 42, and 44 as well as the guide bar 78 and carriage 76. A quick release 94 is located in the top portion of the carriage 76 and a plastic tab 98 attached to the blade 82 facilitates its withdrawal from the carriage by continuous squeezing on guide release 94. After a new blade has been inserted, the squeezing pressure on the quick release 94 is released and the blade is automatically locked into position. When the housing is closed, the knife disabling switch which prohibits accidental firing of the solenoid and operation of the cutter blade is overridden thereby permitting normal operation. The two sets of rollers keep the web of material tensioned so that the cutter blade will effectively cut the web even when the blade does not have an optimum cutting edge.

The housing may be vertically elongated and provided with duplicative supporting, dispensing and cutting arrangements as well as controls in order to dispense and cut-off different materials such as paper toweling, aluminum foil, plastic wrap and the like. This will provide a convenient and attractive kitchen appliance which supports and provides quick and easy dispensing of materials such as are normally placed loosely in a cabinet in their own containers such as aluminum foil, plastic wrap, wax paper, sandwich bags, plastic bags and the like. If desired, a heat sealing arrangement can be provided for tubular plastic material wound on a roll so that when the tubular web is cut, one end is sealed to form a bag. The housing may be constructed of plastic or sheet metal and colored in any suitable decorative color or design to provide an attractive appliance for use in the kitchen.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A dispenser for rolled sheet material comprising a hollow housing, means in the housing to support a roll of sheet material, said housing including a discharge slot through which a web of sheet material can be discharged, means in said housing to move a web of material through the discharge slot, and means in said housing for cutting the web of material adjacent the slot, said cutting means being operative in response to cessation of operation of the means discharging a web of sheet material through the slot, said means to move a web of sheet material through the slot including two pairs of horizontal rollers disposed adjacent to and parallel to the slot with the rollers in each pair being disposed in vertically aligned opposed relation for frictionally engaging the top and bottom surface of a web of sheet material passing therebetween and means driving the rollers moving the web of sheet material through the discharge slot, said means driving the rollers including an electric motor, an actuator operating a switch connected with the electric motor for operating the electric motor continuously while the actuator is depressed and automatically stopping the motor when released, said cutting means including a guide bar extending longitudinally in the housing in parallel relation to the rollers and discharge slot and located above the rollers, a carriage movably mounted on the bar and a cutter blade mounted on the carriage for movement therewith with the cutter blade extending into the area between the pairs of rollers for cutting a web of sheet material passing between the rollers in taut condition and means reciprocating the carriage and cutter blade along the guide bar, said housing including an openable end wall to enable insertion and removal of a roll of sheet material, said housing including means releasably engaging a hollow core in the roll of sheet material, said rollers being located inwardly of the slot in closely spaced relation thereto and in closely spaced relation to each other whereby the end of the web cut by the cutter blade will be disposed between the pairs of rollers thereby eliminating the free end of the web from projecting out of the discharge slot after the web has been cut between the pairs of rollers, said means in the housing releasably engaging a hollow core in the roll of sheet material including a pair of opposed, freely rotatable conical members, at least one of said conical members including a coil spring biasing the conical member into contact with the core of the roll of sheet material to provide a frictional resistance to free rotation of the roll of sheet material to prevent the sheet material from unwinding from the roll until pulled by the driven rollers, said housing including a pivotal support for the spring biased conical member to enable the spring biased conical member and support to be pivoted to a position to enable insertion and removal of a roll of sheet material when the openable end wall of the housing is opened, the innermost pair of rollers being located generally tangentially of the roll of sheet material when the roll of sheet material is initially inserted into the housing, a pair of diverging guide plates extending from the rollers towards the roll of sheet material to guide the sheet material into the pair of feed rollers closest to the roll of sheet material, said means reciprocating the carriage and cutter blade includes a solenoid for projecting the carriage longitudinally of the guide bar, and an interlock switch operable by the openable end of the housing to preclude operation of the solenoid or drive motor when the housing is opened to replace a roll of sheet material.

* * * * *